US007189269B2

(12) United States Patent
Clark et al.

(10) Patent No.: US 7,189,269 B2
(45) Date of Patent: Mar. 13, 2007

(54) FUEL COMPOSITION COMPRISING A BASE FUEL, A FISCHER TROPSCH DERIVED GAS OIL, AND AN OXYGENATE

(75) Inventors: Richard Hugh Clark, Chester (GB); Adrian Philip Groves, Chester (GB); Christopher Morley, Chester (GB); Johanne Smith, Chester (GB)

(73) Assignee: Shell Oil Company, Houston, TX (US)

( * ) Notice: Subject to any disclaimer, the term of this patent is extended or adjusted under 35 U.S.C. 154(b) by 260 days.

(21) Appl. No.: 10/686,978

(22) Filed: Oct. 16, 2003

(65) Prior Publication Data

US 2004/0128905 A1 Jul. 8, 2004

(30) Foreign Application Priority Data

Oct. 18, 2002 (EP) ..... 02257258

(51) Int. Cl.
*C08L 1/18* (2006.01)

(52) U.S. Cl. ..... 44/388; 44/398

(58) Field of Classification Search ..... 44/398, 44/388

See application file for complete search history.

(56) References Cited

U.S. PATENT DOCUMENTS

| | | | | |
|---|---|---|---|---|
| 2,243,760 | A | 5/1941 | Mulheim-Speldorf | 44/9 |
| 4,125,566 | A | 11/1978 | Trin Dinh et al. | 260/676 R |
| 4,208,190 | A | 6/1980 | Malec | 44/53 |
| 4,478,955 | A | 10/1984 | Pesa et al. | 518/713 |
| 5,004,478 | A * | 4/1991 | Vogel et al. | 44/398 |
| 5,324,335 | A | 6/1994 | Benham et al. | 44/452 |
| 5,689,031 | A | 11/1997 | Berlowitz et al. | 585/734 |
| 6,056,793 | A | 5/2000 | Suppes | 44/446 |
| 6,204,426 | B1 | 3/2001 | Miller et al. | 585/739 |
| 2001/0045054 | A1 | 11/2001 | Naegeli et al. | 44/603 |
| 2002/0112466 | A1 * | 8/2002 | Roos et al. | 60/274 |
| 2003/0177692 | A1 * | 9/2003 | Arters et al. | 44/418 |

FOREIGN PATENT DOCUMENTS

| | | | |
|---|---|---|---|
| DE | 683927 | | 11/1939 |
| DE | 43 08 053 | A1 | 9/1994 |
| EP | 0147873 | | 8/1984 |
| EP | 0147240 | A2 | 12/1984 |
| EP | 0482253 | A1 | 10/1990 |
| EP | 0557561 | A1 | 2/1992 |
| EP | 0583836 | A1 | 8/1993 |
| EP | 0613938 | A1 | 2/1994 |
| EP | 0557516 | B1 | 7/1996 |
| EP | 1101813 | A1 | 11/2000 |
| GB | 960493 | | 6/1964 |
| GB | 2077289 | A | 6/1981 |
| WO | WO 97/14768 | | 4/1997 |
| WO | WO 97/14769 | | 4/1997 |
| WO | WO 98/42808 | | 10/1998 |
| WO | WO 00/11116 | | 3/2000 |
| WO | WO 00/11117 | | 3/2000 |
| WO | WO 00/20534 | | 4/2000 |
| WO | WO 00/20535 | | 4/2000 |
| WO | WO 01/07540 | A2 | 2/2001 |
| WO | WO 01/83406 | A2 | 11/2001 |
| WO | WO 01/83641 | A2 | 11/2001 |
| WO | WO 01/83647 | A2 | 11/2001 |
| WO | WO 01/83648 | A2 | 11/2001 |
| WO | WO 01/834406 | A2 | 11/2001 |

OTHER PUBLICATIONS

"The Shell Middle Distillate Synthesis Process," M.J. van der Burgt, J. van Klinken, S.T. Sie (paper delivered at the 5th Synfuels Worldwide Symposium, Washington DC, Nov. 1985).

"The Performance of Diesel Fuel Manufactured by Shell's GtL Technology in the Latest Technology Vehicles," by R.H. Clark, I.G. Virrels, C. Maillard, M. Schmidt, Proceedings of 3rd Int. Colloquium, "Fuels," Tech. Akad. Esslingen, Ostfilder, Germany, 2001.

"The Performance of Diesel Fuel Manufactured by the Shell Middle Distillate Synthesis Process," by R.H. Clark and J.F. Unsworth, Proceedings of 2nd Int. Colloquium, "Fuels," Tech. Akad. Esslingen, Ostfildern, Germany, 1999.

Markus Laaksonen, "The effect of vegetable-oil based fuel on the operation of a high-speed diesel engine equipped with a distributor type fuel injection pump", Helsinki University of Technology Abstract of the Master's Thesis, 1997, http://www.hut.fl/~mplaakso/abstract.txt.

* cited by examiner

*Primary Examiner*—Edward J. Cain

(57) ABSTRACT

A fuel composition is provided containing (i) a base fuel, (ii) a Fischer-Tropsch derived gas oil and (iii) an oxygenate. The components (ii) and (iii) can be used in a tertiary fuel blend with a base fuel (i) for the purpose of achieving for the composition (a) a neutral or close to neutral effect on elastomeric components compared to that of the base fuel, and/or (b) a neutral or better emissions performance (in particular with respect to $NO_x$ and/or particulate emissions) compared to that of the base fuel, preferably in addition to a neutral or close to neutral density for the composition with respect to that of the base fuel.

41 Claims, No Drawings

FUEL COMPOSITION COMPRISING A BASE FUEL, A FISCHER TROPSCH DERIVED GAS OIL, AND AN OXYGENATE

FIELD OF INVENTION

The present invention relates to fuel compositions, and to the use of certain types of fuel in them.

BACKGROUND OF THE INVENTION

Known diesel fuel components include the reaction products of Fischer-Tropsch methane condensation processes, for example the process known as Shell Middle Distillate Synthesis (van der Burgt et al, "The Shell Middle Distillate Synthesis Process", paper delivered at the 5$^{th}$ Synfuels Worldwide Symposium, Washington D.C., November 1985; see also the November 1989 publication of the same title from Shell International Petroleum Company Ltd, London, UK). These Fischer-Tropsch derived gas oils are low in undesirable fuel components such as sulfur, nitrogen and aromatics and are typically blended with other diesel base fuels, for instance petroleum derived gas oils, to modify the base fuel properties.

Other known diesel fuel components include the so-called "biofuels" which derive from biological materials. Examples include alcohols such as methanol and ethanol, and vegetable oils and their derivatives. Most such biofuels are oxygenates, i.e. they contain oxygen in their structure which influences their physicochemical properties and their performance relative to that of straight hydrocarbon fuels.

Biofuels such as rapeseed methyl ester (RME) have been included in diesel fuel blends in order to reduce life cycle greenhouse gas emissions and restore lubricity in particular to fuels which have been subjected to high levels of hydrotreatment to reduce sulfur levels. They are however known to increase the density of the blend with respect to the base fuel and often to increase regulated emissions such as of nitrogen oxides ($NO_x$).

Current commercially available compression ignition (diesel) engines tend to be optimized to run on fuels having a desired specification, in particular a density within a specified range. The blending of a standard commercial diesel base fuel with other fuel components, to modify the overall fuel properties and/or performance, can therefore have an adverse impact on the performance of the blend in the engines for which it is intended.

A further complication can arise when an engine is run on a fuel blend instead of a standard base fuel. Within the engine's fuel injection system, the fuel comes into contact with a range of elastomeric materials, in particular fuel pump seals. In use, many of these elastomers swell on contact with diesel fuel to an extent which depends on the chemistry of the fuel, aromatic fuel components and oxygenates serving for instance to promote swelling.

New elastomers in a fuel injection system tend to equilibrate with a uniform fuel diet and can thus provide with reasonable consistency the required level of sealing. They become vulnerable, however, if a change in fuel diet causes any significant change in the degree of elastomer swell. In the worst cases a mixed fuel diet can stress the elastomeric components of an engine to such an extent that fuel leakage results. By way of example, inclusion of RME in a diesel fuel blend may cause an increase in elastomer swell and in cases engine seal failure.

For the above reasons, it is desirable for any diesel fuel blend to have an overall specification as close as possible to that of the standard commercially available diesel base fuels for which engines tend to be optimized. For example it is desirable that the density of the blend be as close as possible to that of the optimal base fuel. In other words, the blend is ideally "neutral", or as near to neutral as possible, with respect to the relevant base fuel property.

This can however be difficult to achieve because any additional fuel component is likely to alter the properties and performance of the base fuel. Moreover the properties of a blend, in particular its effect on elastomeric engine components and on emissions performance, are not always straightforward to predict from the properties of the constituent fuels alone, the constituents often contributing in a non-linear fashion to the overall blend properties. The greater the number of fuel components in a blend, the less predictable its overall properties become.

SUMMARY OF THE INVENTION

A fuel composition is provided comprising (i) a base fuel, (ii) a Fischer-Tropsch derived gas oil and (iii) an oxygenate. Further, methods of operating engines with such fuel composition are also provided.

DETAILED DESCRIPTION OF THE INVENTION

It has now been found that certain diesel fuel blends can be formulated to mimic more closely the properties and/or performance of a standard diesel fuel. In particular it has been discovered that a diesel base fuel can be blended with certain combinations of fuel components to achieve an overall fuel composition having not only a neutral or close to neutral density compared to the base fuel alone, but also neutral or close to neutral elastomer swell effects and/or neutral or better emissions (in particular $NO_x$ and/or particulate emissions) performance.

In an embodiment of the present invention there is provided a fuel composition comprising (i) a base fuel, (ii) a Fischer-Tropsch derived gas oil and (iii) an oxygenate. It has been found that such tertiary fuel blends can be formulated not only to mimic more closely the properties of the base fuel, but also to give overall improved performance (in particular emissions performance), compared to the base fuel alone and/or to primary blends containing only one of components (ii) and (iii) in the base fuel (i).

In another embodiment of the present invention there is provided the use, in a fuel composition containing a base fuel (i), of both (ii) a Fischer-Tropsch derived gas oil and (iii) an oxygenate, for the purpose of achieving for the composition:

a) a neutral or close to neutral effect on elastomeric components compared to that of the base fuel, and/or b) a neutral or better emissions performance compared to that of the base fuel, preferably in addition to a neutral or close to neutral density for the composition with respect to that of the base fuel.

The fuel composition of the present invention is preferably a diesel fuel composition. The oxygenate is preferably an added component.

The present invention may thus be used to formulate tertiary fuel blends which mimic the properties and performance of a desired base fuel. Such blends are expected to be of particular use in modern commercially available diesel engines as alternatives to the standard diesel base fuels, for instance as commercial and legislative pressures favor the use of increasing quantities of organically derived "biofuels".

That elastomer swell effects and/or emissions performance can be optimized in this way, in a tertiary blend, is by no means easy to predict from the properties of the individual fuel components, in particular under the additional constraint of achieving a neutral or close to neutral density.

In the context of the present invention, use of a fuel component in a fuel composition means incorporating the component into the composition, typically as a blend (i.e. a physical mixture) with one or more other fuel components, conveniently before the composition is introduced into an engine or other power unit.

According to the present invention, the fuel composition will typically contain a major amount of the base fuel (i), such as from 50 to 95% v/v, preferably from 60 to 90% v/v, more preferably from 60 to 75% v/v. The amounts of the additional components (ii) and (iii) will be chosen to achieve the desired degree of neutrality with respect to fuel density and elastomer swell effects, and the desired emissions performance, and may also be influenced by other properties required of the overall composition.

By "effect on elastomeric components" is meant changes in the physical properties (e.g. volume, hardness and/or flexibility) of a given elastomeric material on contact with, suitably immersion in, the relevant fuel or fuel composition, for instance inside a diesel engine or other power unit into which the relevant fuel is introduced. Typically such changes include an increase in volume and/or a reduction in hardness. They may be measured using standard test procedures such as BS903, ASTM D471 or D2240, for instance as described in Example 2 below. They may be assessed in particular for nitrile (including hydrogenated nitrile) elastomers, or for fluoroelastomers which tend however to be less sensitive to fuel changes in this context.

Preferably components (ii) and (iii) are present in the fuel composition in an amount effective to provide a) a neutral or close to neutral effect on elastomeric components compared to that of the base fuel, and/or b) a neutral or better emissions performance compared to that of the base fuel, optionally in addition to a neutral or close to neutral density for the composition with respect to that of the base fuel.

In one embodiment, preferably the fuel components (ii) and (iii) are included in the fuel composition at proportions such as to cause a change in volume of any given elastomeric material (for example a nitrile type such as EOL 280 (James Walker & Co Ltd, UK)) which is from 60 to 140%, more preferably from 70 to 130%, most preferably from 75 to 125% or from 80 to 120% or from 85 to 115%, of that caused by the base fuel when tested under the same conditions. Yet more preferably, the proportions are such as to achieve a change in elastomer volume which is no higher than that caused by the base fuel alone, ideally 95% or 90% or 85% or less of that caused by the base fuel.

In another embodiment, preferably the fuel components (ii) and (iii) are included in the fuel composition at proportions such as to cause a change in hardness of any given elastomeric material (for example a nitrile type such as EOL 280) which is from 70 to 130%, more preferably from 75 to 125%, most preferably from 80 to 120% or from 85 to 115% or from 90 to 110% or even from 95 to 105%, of that caused by the base fuel when tested under the same conditions. Yet more preferably, the proportions are such as to achieve a change in elastomer hardness which is no higher than that of the base fuel alone, ideally 95% or 90% or 85% or less of that caused by the base fuel.

By "emissions performance" is meant the amount of combustion-related emissions (such as particulates, nitrogen oxides, carbon monoxide, gaseous (unburned) hydrocarbons and carbon dioxide) generated by a diesel engine or other unit running on the relevant fuel or fuel composition. In the context of the present invention, emissions of particulates and/or of nitrogen oxides $NO_x$ are of particular interest, as are so-called "greenhouse emissions" of carbon dioxide.

A "neutral" emissions performance is achieved when the fuel composition causes the same level of emissions, under a given set of test conditions (including engine type), as that generated by the base fuel (i). A better than neutral performance is achieved when the level of emissions generated by the fuel composition, under a given set of test conditions, is lower than that generated by the base fuel. Such performance may be with respect to one or more of the types of emission referred to above.

Emission levels may be measured using standard testing procedures such as the European R49, ESC, OICA or ETC (for heavy-duty engines) or ECE+EUDC or MVEG (for light-duty engines) test cycles. Ideally emissions performance is measured on a diesel engine built to comply with the Euro II standard emissions limits (1996) or with the Euro III (2000), IV (2005) or even V (2008) standard limits. A heavy-duty engine is particularly suitable for this purpose. Gaseous and particle emissions may be determined using for instance a Horiba Mexa™ 9100 gas measurement system and an AVL Smart Sampler™ respectively.

In another embodiment, preferably the fuel components (ii) and (iii) are included in the composition at proportions such as to achieve a level of emissions (in particular $NO_x$ and/or particulate emissions) which is lower than that from the base fuel alone under a given set of test conditions, ideally 95% or less of that from the base fuel, more suitably 90% or 80% or 75% or 50% or less.

Conveniently the proportions of (ii) and (iii) are also such as to achieve a level of emissions of carbon monoxide, gaseous hydrocarbons and/or carbon dioxide which are within the above described limits as compared to the corresponding emissions generated by the base fuel alone. They are suitably also such as to achieve a level of carbon dioxide emissions which is no greater than, preferably lower than (such as 99% or less of or even 95% or less of) that generated by the base fuel (i) alone, as measured over the fuel's lifecycle analysis (e.g., using ISO 14040 lifecycle analysis methodology).

Components (i) to (iii) should be present in relative proportions such that the density of the overall fuel composition is as close as possible to that of the base fuel (i) alone. Preferably the density of the overall composition is from 95 to 105% of that of the base fuel, more preferably from 98 to 102%, most preferably from 99 to 101% or even from 99.5 to 100.5%.

It may for instance be from 0.75 to 0.9 g/cm$^3$, preferably from 0.8 to 0.85 g/cm$^3$, more preferably from 0.82 to 0.85 g/cm$^3$ at 15° C. (e.g., ASTM D4502 or IP 365).

Conveniently the density of the composition is within the current commercial diesel specification EN 590/2002.

The fuel compositions to which the present invention relates include diesel fuel compositions for use in automotive compression ignition engines, as well as in other types of engine such as for example marine, railroad and stationary engines, and industrial gas oil compositions for use in heating applications (e.g. boilers).

The base fuel (i) may be a diesel fuel of conventional type, typically comprising liquid hydrocarbon middle distillate fuel oil(s), for instance petroleum derived gas oils. It may be organically or synthetically derived, although not Fischer-Tropsch derived. Such fuels will typically have boiling points within the usual diesel range of 150 to 400° C., depending on grade and use.

Said base fuel preferably contains no more than 5000 ppmw (parts per million by weight) of sulfur, and more preferably is a low or ultra low sulfur fuel, or a sulfur free fuel, for instance containing at most 500 ppmw, preferably no more than 350 ppmw, most preferably no more than 100 or 50 or even 10 ppmw, of sulfur.

Said base fuel will typically have a density from 0.75 to 0.9 g/cm$^3$, preferably from 0.8 to 0.86 g/cm$^3$, at 15° C. (e.g., ASTM D4502 or IP 365) and a cetane number (ASTM D613) of from 35 to 80, more preferably from 40 to 75. It will typically have an initial boiling point in the range 150 to 230° C. and a final boiling point in the range 290 to 400° C. Its kinematic viscosity at 40° C. (ASTM D445) might suitably be from 1.5 to 4.5 mm$^2$/s.

The base fuel may itself comprise a mixture of two or more different diesel fuel components, and/or be additivated as described below.

The base fuel (i) may also be an industrial gas oil which may comprise fuel fractions such as the kerosene or gas oil fractions obtained in traditional refinery processes, which upgrade crude petroleum feedstock to useful products. Preferably such fractions contain components having carbon numbers in the range 5–40, more preferably 5–31, yet more preferably 6–25, most preferably 9–25, and such fractions have a density at 15° C. of 650–950 kg/cm$^3$, a kinematic viscosity at 20° C. of 1–80 mm$^2$/s, and a boiling range of 150–400° C.

For diesel fuel applications, the Fischer-Tropsch derived gas oil (ii) should be suitable for use as a diesel fuel. Its components (or the majority, for instance 95% w/w or greater, thereof) should therefore have boiling points within the typical diesel fuel ("gas oil") range, i.e. from about 150 to 400° C. or from 170 to 370° C. It will suitably have a 90% w/w distillation temperature of from 300 to 370° C.

By "Fischer-Tropsch derived" is meant that the fuel is, or derives from, a synthesis product of a Fischer-Tropsch condensation process. The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g., 125 to 300° C., preferably 175 to 250° C.) and/or pressures (e.g., 5 to 100 bar, preferably 12 to 50 bar). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane.

A gas oil product may be obtained directly from the Fischer-Tropsch reaction, or indirectly for instance by fractionation of a Fischer-Tropsch synthesis product or from a hydrotreated Fischer-Tropsch synthesis product. Hydrotreatment can involve hydrocracking to adjust the boiling range (see, e.g. GB-B-2077289 and EP-A-0147873) and/or hydroisomerisation which can improve cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired gas oil fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. No. 4,125,566 and U.S. Pat. No. 4,478,955, which disclosures are hereby incorporated by reference.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0583836 (pages 3 and 4).

An example of a Fischer-Tropsch based process is the SMDS (Shell Middle Distillate Synthesis) described in "The Shell Middle Distillate Synthesis Process", van der Burgt et al (supra). This process (also sometimes referred to as the Shells™ "Gas-to-Liquids" or "GtL" technology) produces middle distillate range products by conversion of a natural gas (primarily methane) derived synthesis gas into a heavy long-chain hydrocarbon (paraffin) wax which can then be hydroconverted and fractionated to produce liquid transport fuels such as the gas oils useable in diesel fuel compositions. A version of the SMDS process, utilizing a fixed-bed reactor for the catalytic conversion step, is currently in use in Bintulu, Malaysia and its products have been blended with petroleum derived gas oils in commercially available automotive fuels.

Gas oils prepared by the SMDS process are commercially available for instance from the Royal Dutch/Shell Group of Companies. Further examples of Fischer-Tropsch derived gas oils are described in EP-A-0583836, EP-A-1101813, WO-A-97/14768, WO-A-97/14769, WO-A-00/20534, WO-A-00/20535, WO-A-00/11116, WO-A-00/11117, WO-A-01/83406, WO-A-01/83641, WO-A-01/83647, WO-A-01/83648 and U.S. Pat. No. 6,204,426 which disclosure is hereby incorporated by reference.

Suitably, in accordance with the present invention, the Fischer-Tropsch derived gas oil will consist of at least 70% w/w, preferably at least 80% w/w, more preferably at least 90% w/w, most preferably at least 95% w/w, of paraffinic components, preferably iso- and linear paraffins. The weight ratio of iso-paraffins to normal paraffins will suitably be greater than 0.3 and may be up to 12; suitably it is from 2 to 6. The actual value for this ratio will be determined, in part, by the hydroconversion process used to prepare the gas oil from the Fischer-Tropsch synthesis product. Some cyclic paraffins may also be present.

By virtue of the Fischer-Tropsch process, a Fischer-Tropsch derived gas oil has essentially no, or undetectable levels of, sulfur and nitrogen. Compounds containing these heteroatoms tend to act as poisons for Fischer-Tropsch catalysts and are therefore removed from the synthesis gas feed. Further, the process as usually operated produces no or virtually no aromatic components. The aromatics content of a Fischer-Tropsch gas oil, as determined for instance by ASTM D4629, will typically be below 1% w/w, preferably below 0.5% w/w and more preferably below 0.1% w/w.

The Fischer-Tropsch derived gas oil used in the present invention will typically have a density from 0.76 to 0.79 g/cm$^3$ at 15° C.; a cetane number (ASTM D613) greater than 70, suitably from 74 to 85; a kinematic viscosity (ASTM D445) from 2 to 4.5, preferably 2.5 to 4.0, more preferably from 2.9 to 3.7, mm$^2$/s at 40° C.; and a sulphur content (ASTM D2622) of 5 ppmw (parts per million by weight) or less, preferably of 2 ppmw or less.

Preferably it is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

The oxygenate (iii) is an oxygen containing compound, preferably containing only carbon, hydrogen and oxygen. It may suitably be a compound containing one or more hydroxyl groups —OH, and/or one or more carbonyl groups C═O, and/or one or more ether groups —O—, and/or one or more ester groups —C(O)O—. It preferably contains from 1 to 18 carbon atoms and in certain cases from 1 to 10 carbon atoms. Ideally it is biodegradable. It is suitably derived from organic material, as in the case of currently available "biofuels" such as vegetable oils and their derivatives.

Preferred oxygenates for use in the present invention are esters, for example alkyl (preferably $C_1$ to $C_8$ or $C_1$ to $C_5$, such as methyl or ethyl) esters of carboxylic acids or of vegetable oils. The carboxylic acid in this case may be an optionally substituted, straight or branched chain, mono-, di- or multi-functional $C_1$ to $C_6$ carboxylic acid, typical substituents including hydroxy, carbonyl, ether and ester groups. Suitable examples of oxygenates (iii) include succinates and levulinates.

Ethers are also usable as the oxygenate (iii), for example dialkyl (typically $C_1$ to $C_6$) ethers such as dibutyl ether and dimethyl ether.

Alternatively the oxygenate may be an alcohol, which may be primary, secondary or tertiary. It may in particular be an optionally substituted (though preferably unsubstituted) straight or branched chain $C_1$ to $C_6$ alcohol, suitable examples being methanol, ethanol, n-propanol and isopropanol. Typical substituents include carbonyl, ether and ester groups. Methanol and in particular ethanol may for instance be used as component (iii).

The oxygenate (iii) will typically be a liquid at ambient temperature, with a boiling point preferably from 100 to 360° C., more preferably from 250 to 290° C. Its density is suitably from 0.75 to 1.2 g/cm$^3$, more preferably from 0.75 to 0.9 g/cm$^3$ at 15° C. (ASTM D4502/IP 365), and its flash point greater than 55° C.

The relative proportions of the fuel components (i) to (iii) in the overall composition will depend on the exact nature of those components and the properties and/or performance desired of the composition. Typically the Fischer-Tropsch derived component (ii) will be present at from 5 to 40% v/v of the overall composition, preferably from 8 to 35% v/v, more preferably from 25 to 35% v/v. The oxygenate (iii) will typically be present at from 0.1 to 30% v/v of the overall composition, preferably from 0.5 to 10% v/v, more preferably from 1 to 8% v/v, most preferably from 2 to 7% v/v—in this case the amount may depend on the nature of component (iii), those of lower molecular weight (e.g., those having from 1 to 8 carbon atoms) typically being useable at lower concentrations such as from 0.5 to 5% v/v or from 0.5 to 2% v/v.

The volume ratio of component (ii) to component (iii) may suitably be up to 35:1, preferably 30:1 or less, more preferably 20:1 or 15:1 or 10:1 or 7:1 or 6:1 or less. It may be as low as 1:1, preferably no less than 1.5:1, more preferably no less than 2:1 or 3:1.

In the case where component (iii) is a $C_8$ to $C_{22}$ vegetable oil derivative such as an alkyl (typically methyl to pentyl) vegetable oil ester, in particular rapeseed methyl ester, it may suitably be present at a concentration of from 1 to 30% v/v, preferably from 1 to 10% v/v, more preferably from 3 to 7% v/v, and the volume ratio of (ii) to (iii) may suitably be in the range 10:1 to 1:1, preferably from 7:1 to 1.5:1 or from 6:1 to 2:1. The oxygenate concentration may be greater than 5% v/v.

Particularly suitable compositions contain:

a) from 25 to 35% v/v, preferably from 28 to 32% v/v, of the Fischer-Tropsch component (ii) and from 3 to 7% v/v, preferably from 4 to 6% v/v, of the vegetable oil derivative (iii); or b) from 7 to 12% v/v, preferably from 9 to 11% v/v, of the Fischer-Tropsch component (ii) and from 3 to 7% v/v, preferably from 4 to 6% v/v, of the vegetable oil derivative (iii).

In the case where component (iii) is a succinate such as an alkyl (typically $C_1$ to $C_5$ alkyl, such as in dimethyl or diethyl) succinate, it may suitably be present at a concentration of from 1 to 10% v/v, preferably from 3 to 9% v/v or from 4 to 6% v/v, and the volume ratio of (ii) to (iii) may suitably be in the range 10:1 to 2:1, preferably from 7:1 to 3:1 or from 6:1 to 3.5:1. Particularly suitable compositions may then contain from 25 to 35% v/v, preferably from 28 to 32% v/v, of the Fischer-Tropsch component (ii) and from 2 to 10% v/v, preferably from 4 to 6% v/v or from 7 to 9% v/v, of the succinate.

In the case where component (iii) is a levulinate such as an alkyl (typically methyl to pentyl) levulinate, it may suitably be present at a concentration of from 0.5 to 5% v/v, preferably from 0.8 to 3% v/v, and the volume ratio of (ii) to (iii) may suitably be in the range 40:1 to 10:1, preferably from 35:1 to 10:1. Particularly suitable compositions may then contain from 25 to 35% v/v, preferably from 28 to 32% v/v, of the Fischer-Tropsch component (ii) and from 0.5 to 5% v/v, preferably from 0.5 to 3% v/v, of the levulinate.

In these cases, the Fischer-Tropsch component (ii) is suitably of the preferred type described above. Conveniently it is a Fischer-Tropsch derived fuel as used in Examples 1 and 2 below, or one having the same or a similar density and/or emissions performance and/or effect on elastomeric materials.

The fuel composition may contain, in accordance with the invention, more than one Fischer-Tropsch derived component (ii), and/or more than one oxygenate (iii), of the types described above.

In accordance with the present invention, the overall fuel composition may contain other fuel components of conventional type, for example diesel fuel components which again will typically have boiling points within the usual diesel range of 150 to 400° C.

The fuel composition may or may not contain additives, which will typically be incorporated together with the base fuel (i). Thus, the composition may contain a minor proportion (preferably less than 1% w/w, more preferably less than 0.5% w/w (5000 ppmw) and most preferably less than 0.2% w/w (2000 ppmw)) of one or more diesel fuel additives.

Generally speaking, in the context of the present invention any fuel component or fuel composition may be additivated (additive-containing) or unadditivated (additive-free). Such additives may be added at various stages during the production of a fuel composition; those added to a base fuel at the refinery for example might be selected from anti-static agents, pipeline drag reducers, flow improvers (eg, ethylene/vinyl acetate copolymers or acrylate/maleic anhydride copolymers) and wax anti-settling agents (eg, those commercially available under the Trade Marks "PARAFLOW" (eg, PARAFLOW™ 450, ex Infineum), "OCTEL" (eg, OCTEL™ W 5000, ex Octel) and "DODIFLOW" (eg, DODIFLOW™ 3958, ex Hoechst).

The fuel composition may for instance include a detergent, by which is meant an agent (suitably a surfactant) which can act to remove, and/or to prevent the build up of, combustion related deposits within an engine, in particular in the fuel injection system such as in the injector nozzles. Such materials are sometimes referred to as dispersant additives.

Where the fuel composition includes a detergent, preferred concentrations lie in the range 20 to 500 ppmw active matter detergent based on the overall fuel composition, more preferably 40 to 500 ppmw, most preferably 40 to 300 ppmw or 100 to 300 ppmw or 150 to 300 ppmw.

Examples of suitable detergent additives include polyolefin substituted succinimides or succinamides of polyamines, for instance polyisobutylene succinimides or polyisobutylene amine succinamides, aliphatic amines, Mannich bases or amines and polyolefin (eg, polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

Detergent-containing diesel fuel additives are known and commercially available, for instance from Infineum (eg, F7661 and F7685) and Octel (eg, OMA 4130D).

Other components which may be incorporated in fuel additives, for instance in combination with a detergent, include lubricity enhancers such as EC 832 and PARADYNE™ (ex Infineum), HITEC™ E580 (ex Ethyl Corporation) and VEKTRON™ 6010 (ex Infineum) and amide-based additives such as those available from the Lubrizol Chemical Company, for instance LZ 539 C; dehazers, e.g., alkoxylated phenol formaldehyde polymers such as those commercially available as NALCO™ EC5462A (formerly 7D07) (ex Nalco), and TOLAD™ 2683 (ex Petrolite); anti-foaming agents (e.g., the polyether-modified polysiloxanes commercially available as TEGOPREN™ 5851 and Q 25907 (ex Dow Corning), SAG™ TP-325 (ex OSi) and RHODORSIL™ (ex Rhone Poulenc)); ignition improvers (cetane improvers) (e.g., 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g., that sold commercially by Rhein Chemie, Mannheim, Germany as "RC 4801", a propane-1, 2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g., the pentaerythritol diester of polyisobutylene-substituted succinic acid); corrosion inhibitors; reodorants; anti-wear additives; anti-oxidants (e.g., phenolics such as 2,6-di-tert-butylphenol, or phenylenediamines such as N,N'-di-sec-butyl-p-phenylenediamine); and metal deactivators.

Unless otherwise stated, the (active matter) concentration of each such additional component in the overall fuel composition is preferably up to 1% w/w, more preferably in the range from 5 to 1000 ppmw, advantageously from 75 to 300 ppmw, such as from 95 to 150 ppmw.

It is particularly preferred that a lubricity enhancer be included in the fuel composition, especially when it has a low (eg, 500 ppmw or less) sulfur content. The lubricity enhancer is conveniently present at a concentration from 50 to 1000 ppmw, preferably from 100 to 1000 ppmw, based on the overall fuel composition.

The (active matter) concentration of any dehazer in the fuel composition will preferably be in the range from 1 to 20 ppmw, more preferably from 1 to 15 ppmw, still more preferably from 1 to 10 ppmw and advantageously from 1 to 5 ppmw. The (active matter) concentration of any ignition improver present will preferably be 600 ppmw or less, more preferably 500 ppmw or less, conveniently from 300 to 500 ppmw.

The present invention may be applicable where the fuel composition is used or intended to be used in a direct injection diesel engine, for example of the rotary pump, in-line pump, unit pump, electronic unit injector or common rail type, or in an indirect injection diesel engine. The fuel composition may be suitable for use in heavy- and/or light-duty diesel engines, emissions benefits often being more marked in heavy-duty engines.

It is also applicable where the fuel composition is used in heating applications, such as boilers, including standard boilers, low temperature boilers and condensing boilers. Such boilers are typically used for heating water for commercial or domestic applications such as space heating and water heating.

Because the present invention is based on the combination of three distinct fuel components to achieve an overall desired effect, it encompasses also, according to a third aspect, the use of a Fischer-Tropsch derived gas oil (ii), in a fuel composition containing both a base fuel (i) and an oxygenate (iii), for the purpose of achieving an effect on elastomeric components which is closer to that of the base fuel (i) than is that of the base fuel/oxygenate blend, and/or for the purpose of achieving an emissions performance which is better than that of the base fuel/oxygenate blend and ideally also as good as or better than that of the base fuel alone.

A fourth aspect of the present invention provides the use of an oxygenate (iii), in a fuel composition containing both a base fuel (i) and a Fischer-Tropsch derived gas oil (ii), for the purpose of achieving an effect on elastomeric components which is closer to that of the base fuel (i) than is that of the base fuel/gas oil blend, and/or for the purpose of achieving an emissions performance which is as good as or better than that of the base fuel alone and preferably no worse than that of the base fuel/gas oil blend.

In the context of these third and fourth aspects of the present invention, the fuel components (i) to (iii) are as defined above in connection with the first and second aspects. Preferred features of the third and fourth aspects, in particular regarding the nature and proportions of the components (i) to (iii) and their effect on fuel properties and performance, may be as described in connection with the first and second aspects. The aim in both third and fourth aspects of the present invention is in each case to optimize the properties and performance of a two-component fuel blend, as compared to the base fuel, by the addition of a third component. This may be done with the concurrent aim of achieving a density which is closer to that of the base fuel than is that of the two-component blend.

Preferably, the emissions performance is the level of $NO_x$ emissions generated by a diesel engine running on the relevant fuel or fuel composition.

A fifth aspect of the present invention provides a method of operating a diesel engine, and/or a vehicle which is driven by a diesel engine, which method involves introducing into a combustion chamber of the engine a diesel fuel composition according to the first aspect of the present invention. This method is preferably carried out for the purpose of increasing consistency between successive fuel compositions on which the engine is run, in particular to enhance consistency with a fuel composition on which the engine has run previously (typically the one on which it is or was running at the time of introduction of the composition according to the present invention).

Instead or in addition, the method may be carried out for the purpose of increasing consistency with a fuel for use with which the engine is optimized. Such increased consistency is typically with respect to the density of the fuel composition and/or its effect on elastomeric engine components and/or its emissions performance, as described above.

In particular, the method of the present invention may be carried out for the purpose of reducing subsequent damage to elastomeric engine components (in particular to components such as seals in the fuel injection system of the engine). Such damage, as described above, may be attributable to a difference in constitution between fuel compositions on which the engine is run, especially to a difference in the effects of those fuel compositions on the volume and/or hardness of elastomeric components.

The method may also be carried out for the purpose of reducing combustion-related emissions from the engine, for instance relative to those generated by running the engine, under the same or comparable test conditions, on another fuel composition and in particular on the base fuel (i) alone.

A sixth aspect of the present invention provides a method of operating a heating appliance provided with a burner, which method comprises supplying to said burner a fuel composition according to the present invention.

A seventh aspect of the present invention provides a process for the preparation of a fuel composition, such as a composition according to the first aspect, which process involves blending a Fischer-Tropsch derived gas oil (ii) and an oxygenate (iii) with a base fuel (i). The blending is ideally carried out for the purpose of achieving, in a diesel engine into which the fuel composition is or is intended to be subsequently introduced, the benefits described above in connection with the fifth aspect of the present invention.

Preferred features of the fifth to seventh aspects of the present invention may be as described above in connection with the first to the fourth aspects.

The present invention will be further understood from the following examples, which illustrate the effects of blending a diesel base fuel with both a Fischer-Tropsch derived gas oil and an oxygenate on the properties and engine performance of the resultant fuel composition as compared to those of the base fuel alone.

General

The tests used a commercially available petroleum derived low sulfur gas oil F1 as a diesel base fuel, and a Fischer-Tropsch (SMDS) derived gas oil F2 (both ex. Shell). The properties of these two fuels are shown in Table A.

TABLE A

| Fuel property | Test method | F1 | F2 |
|---|---|---|---|
| Density @ 15° C. (g/cm$^3$) | ASTM D4052 | 0.840 | 0.776 |
| Distillation | ASTM D86 | | |
| IBP (° C.) | | 180 | 183 |
| 50% | | 276 | 276 |
| 90% | | 338 | 340 |
| FBP | | 365 | 359 |
| Cetane number | ASTM D613 | 53.5 | 81* |
| Kinematic viscosity @ 40° C. (centistokes) | ASTM D445 | 3.02 | 3.10 |
| Cloud point (° C.) | IP 219 | −9 | 0 |
| Sulfur (ppmw) | ASTM D2622 | 270 | <2 |
| Aromatics content (% w/w): | IP 391 (mod) | 26 | <0.1 |
| Flash point (° C.) | | 70.5 | 73 |

*(by extrapolation from measurements (ASTM D613) on fuel blends)

The gas oil F2 had been obtained from a Fischer-Tropsch (SMDS) synthesis product via a two-stage hydroconversion process analogous to that described in EP-A-0583836.

The properties and performance of various blends of the fuels F1 and F2 with the oxygenate fuels F3 to F6 were tested and compared with those of the base fuel F1 alone.

The oxygenates used were:

F3—rapeseed methyl ester (RME) (ex. Diester, France, >90% pure)

F4—anhydrous ethanol (bio-derived, >98% pure)

F5—ethyl levulinate (ex. Avocado Chemicals, UK >98% pure)

F6—diethyl succinate (ex. Avocado Chemicals, UK, >98% pure).

EXAMPLE 1

Fuel Density

Density is a key fuel property due to its potential impact on the volumetric energy content and particulate emission levels, and tends to be a tightly controlled parameter in current commercial fuel specifications (EN590 for 2002, for instance, stipulates between 820 and 845 kg/l).

The densities of various diesel fuel blends (IP 365), based on the petroleum derived gas oil F1, were found to be as shown in Table 1.

TABLE 1

| Example | Conc$^n$ of F2 (SMDS component) (% v/v) | Conc$^n$ of F3 (RME) (% v/v) | Density @ 15° C. (g/cm$^3$) |
|---|---|---|---|
| 1.1 (pure F1) | 0 | 0 | 0.8407* |
| 1.2 (pure F2) | 100 | 0 | 0.784* |
| 1.3 (pure F3) | 0 | 100 | 0.8842* |
| 1.4 | 0 | 5 | 0.8425 |
| 1.5 | 0 | 10 | 0.8447 |
| 1.6 | 0 | 30 | 0.8535 |
| 1.7 | 10 | 5 | 0.8368* |
| 1.8 | 20 | 0 | 0.8290 |
| 1.9 | 20 | 5 | 0.8312 |
| 1.10 | 20 | 10 | 0.8334 |
| 1.11 | 20 | 30 | 0.846* |
| 1.12 | 30 | 5 | 0.8261* |
| 1.13 | 30 | 10 | 0.8278 |
| 1.14 | 30 | 30 | 0.8366 |
| 1.15 | 40 | 0 | 0.8178 |

TABLE 1-continued

| Example | Conc$^n$ of F2 (SMDS component) (% v/v) | Conc$^n$ of F3 (RME) (% v/v) | Density @ 15° C. (g/cm$^3$) |
|---|---|---|---|
| 1.16 | 40 | 5 | 0.8200 |
| 1.17 | 40 | 10 | 0.8222 |
| 1.18 | 40 | 30 | 0.8310 |
| 1.19 | 60 | 0 | 0.8065 |
| 1.20 | 60 | 5 | 0.8087 |
| 1.21 | 60 | 10 | 0.8109 |
| 1.22 | 60 | 30 | 0.8197 |
| 1.23 | 80 | 0 | 0.7953 |
| 1.24 | 80 | 5 | 0.7975 |
| 1.25 | 80 | 10 | 0.7997 |

(*denotes a value measured according to IP 365; other values are calculated.)

Note that the concentration of the base fuel F1 in each case is represented by 100 minus the combined concentrations of F2 and F3.

It can be seen that tertiary blends of the fuels F1, F2 and F3 can be formulated which have neutral, or close to neutral, densities relative to that of the standard diesel fuel F1 alone.

The following blends in particular had densities acceptably close to that of F1:

1.7–10% F2+5% F3 (density 0.8368 g/cm$^3$)

1.11–20% F2+30% F3 (density 0.846 g/cm$^3$)

1.12–30% F2+5% F3 (density 0.8261 g/cm$^3$).

Of these, blends 1.7 and 1.12 have densities within the 2002 EN590 specification. Blend 1.7 in particular might be of use as a maingrade fuel.

Thus, an oxygenate such as F3 (RME) may be added to a blend of a diesel base fuel and a Fischer-Tropsch derived gas oil in order to mitigate the reduction in density, relative to that of the base fuel alone, caused by the presence of the Fischer-Tropsch fuel component.

Conversely, a Fischer-Tropsch derived gas oil such as F2 may be added to a blend of a diesel base fuel and an oxygenate such as a vegetable oil ester in order to mitigate the increase in density caused by the presence of the oxygenate.

These phenomena may be of advantage in terms of vehicle optimization for the currently accepted diesel fuel specifications, and may help to improve the consumer acceptability of alternative fuel blends.

EXAMPLE 2

Elastomer Swell Effects

The effects of various fuel blends on elastomeric seals were assessed using a test procedure based on that of BS903 Part A16, which is broadly similar to the ASTM D471 and D2240 procedures. The volume and average Shore hardness of elastomer samples nominally 50×25 mm×3 mm thickness were measured both before and after immersion in 100 ml of the fuel under test at 70° C. for 168 hours. Immediately following their removal from the 70° C. test fuel the samples were cooled in a fresh quantity of the same fuel at ambient temperature for 15 minutes. They were then quickly surface dried, weighed in air and in water and their new volume and hardness measured within 24 to 48 hours of their removal from the test medium. The percentage change in volume and in average hardness, due to exposure to the relevant test fuel, were then calculated for each sample.

Hardness was measured at ambient temperature using a Type A Shore™ Durometer (Shore Instruments, USA).

The blends tested contained the diesel base fuel F1 together with varying proportions of the Fischer-Tropsch component F2 and the oxygenate F3 (RME). Tests were conducted on two elastomers, EOL 280 (a hydrogenated nitrile) and LR6316 (a fluorocarbon tetrapolymer) (both ex James Walker & Co Ltd, UK). The results are shown in Table 2.

TABLE 2

| Exp$^t$ no. | Conc$^n$ of F2 (% v/v) | Conc$^n$ of F3 (% v/v) | Density of fuel blend @ 15° C. (IP 365) (kg/m$^3$) | EOL 280 % vol change/% change in hardness | LR 6316 % vol change/% change in hardness |
|---|---|---|---|---|---|
| 2.1 | 0 (pure F1) | 0 | 840.7 | 9.8/−7.0 | 1.4/−2.8 |
| 2.2 | 0 (pure F1 - repeat) | 0 | 840.7 | 9.1/−7.7 | |
| 2.3 | 100 (pure F2) | 0 | 784 | 1.2/−0.78 | 0.39/−2.4 |
| 2.4 | 0 | 100 (pure F3) | 884.2 | 11.2/−9.0 | 1.7/−2.8 |
| 2.5 | 0 | 100 (pure F3 - repeat) | 884.2 | 11.0/−9.9 | |
| 2.6 | 0 | 5 | | 9.9/−6.6 | 1.5/−2.8 |
| 2.7 | 0 | 30 | 853.2 | 11.5/−8.1 | 1.7/−2.8 |
| 2.8 | 0 | 30 (repeat - new blend) | 853.2 | 10.8/−8.0 | |
| 2.9 | 0 | 50 | 861.9 | 10.8/−8.30 | |
| 2.10 | 30 | 0 | | 7.0/−5.8 | 1.1/−2.4 |
| 2.11 | 50 | 0 | 812.3 | 5.0/−5.0 | |
| 2.12 | 30 | 5 | 826.1 | 7.4/−6.2 | 1.2/−1.6 |
| 2.13 | 10 | 5 | 836.8 | 8.3/−7.3 | |

Again, the concentration of the base fuel F1 in each case is represented by 100 minus the combined concentrations of F2 and F3.

It can be seen from Table 2 that blend number 2.12 (65% F1+30% F2+5% F3) affords an elastomer swell which is close to that of the base fuel F1 alone. Similarly, blend number 2.13 (85% F1+10% F2+5% F3) has reasonably close to neutral elastomer swell properties as compared to F1 alone. The increase in elastomer swell damage caused by blending the base fuel with the oxygenate can be mitigated by the inclusion of a third, Fischer-Tropsch derived, component.

These tests were repeated but using either ethyl levulinate (F5) or diethyl succinate (F6) as an oxygenate fuel component, in blends with the base fuel F1 and the SMDS component F2. The elastomer tested was EOL 280. The results are shown in Table 3.

TABLE 3

| Exp$^t$ no. | Conc$^n$ of F2 (% v/v) | Conc$^n$ of F3 (% v/v) | Conc$^n$ of F5 (% v/v) | Conc$^n$ of F6 (% v/v) | Density of fuel blend @ 15° C. (IP 365) (kg/m$^3$) | % volume change |
|---|---|---|---|---|---|---|
| 2.14 | 0 (pure F1) | 0 | 0 | 0 | 840.7* | 9.1 |
| 2.15 | 100 (pure F2) | 0 | 0 | 0 | 784* | 1.2 |
| 2.16 | 0 | 100 (pure F3) | 0 | 0 | 884.2* | 11.0 |

TABLE 3-continued

| Exp[t] no. | Conc[n] of F2 (% v/v) | Conc[n] of F3 (% v/v) | Conc[n] of F5 (% v/v) | Conc[n] of F6 (% v/v) | Density of fuel blend @ 15° C. (IP 365) (kg/m$^3$) | % volume change |
|---|---|---|---|---|---|---|
| 2.17 | 30 | 0 | 0 | 0 | 823.4 | 7.0 |
| 2.18 | 30 | 5 | 0 | 0 | 826.1* | 7.4 |
| 2.19 | 30 | 0 | 1 | 0 | 825 | 8.3 |
| 2.20 | 30 | 0 | 2 | 0 | 827 | 10.8 |
| 2.21 | 30 | 0 | 0 | 5 | 834 | 12.0 |
| 2.22 | 30 | 0 | 0 | 8 | 840 | 16.0 |

(*denotes a value measured according to IP 365; other values are calculated.)

Again, the concentration of the base fuel F1 in each case is represented by 100 minus the combined concentrations of F2, F3, F5 and F6.

Table 3 identifies blend numbers 2.19 (69% F1+30% F2+1% F5), 2.20 (68% F1+30% F2+2% F5) and 2.21 (65% F1+30% F2+5% F6) as giving elastomer swell close to that of F1 alone. Blend number 2.18 (65% F1+30% F2+5% F3) again, as in Table 2, exhibits a closer to neutral elastomer swell effect, as compared to the base fuel F1, than the two-component blend of F1 with 30% F2.

The data in Tables 2 and 3 demonstrate that a Fischer-Tropsch derived gas oil and an oxygenate may compensate for one another's elastomer swell effects in an overall fuel blend. This synergy allows a blend to be formulated which not only possesses the benefits contributed by the two components but at the same time suffers less from the drawbacks associated with the use of either of the components alone.

Thus, it is possible to formulate tertiary fuel blends which not only have (as identified in Example 1) acceptable densities with respect to that of the base fuel, but also (as shown in this example) have neutral or close to neutral elastomer swell properties with respect to the base fuel. Such optimized blends are less likely to cause damage to elastomeric engine components, and hence fuel leakage, than other blends which less closely mimic the properties of the standard commercially available diesel fuels for which engines are currently optimized.

EXAMPLE 3

An additional benefit associated with tertiary fuel blends according to the invention is found in their emissions performance, in particular with respect to $NO_x$ and particulate emissions. The use of both a Fischer-Tropsch derived fuel and an oxygenate together can yield surprising improvements in performance compared to those expected of the individual constituent fuels in primary blends with diesel base fuels.

It has previously been shown that levels of $NO_x$ emissions are increased when an oxygenate such as RME is incorporated into a primary blend with a diesel base fuel.

Although it is known that Fischer-Tropsch fuels can reduce levels of such regulated emissions as compared to standard diesel base fuels [see, eg, Clark, Virrels, Maillard and Schmidt, "The performance of diesel fuel manufactured by Shell's GtL technology in the latest technology vehicles", FUELS 2000 3rd *International Colloquium*, January 2001, Technische Akademie Esslingen, and Clark & Unsworth, "The performance of diesel fuel manfactured by the Shell Middle Distilate Synthesis process", *FUELS* 1999 2nd *International Colloquium*, January 1999, Technische Akademie Esslingen], such improvements have only been demonstrated for the Fischer-Tropsch fuels alone or in primary blends with base fuels.

In accordance with the present invention, however, it has now been found possible to formulate tertiary blends which provide both synergistic improvements in "regulated" emissions levels and neutral or better "greenhouse" (carbon dioxide) emissions levels, together with other desirable attributes such as close to neutral densities and/or elastomer swell effects. At these optimized levels of components (ii) and (iii), the overall blend can be formulated to give neutral or better emissions levels with respect to those from the base fuel alone.

In particular, tertiary fuel blends according to the present invention can surprisingly provide a neutral or reduced level of $NO_x$ emissions compared to that from standard diesel base fuels, as well as a reduced level of $NO_x$ emissions compared to that from a binary blend of base fuel and oxygenate.

Moreover the fuel compositions of the present invention offer the ability to reduce particulate emissions below those from binary blends of either base fuel and Fischer-Tropsch fuel or base fuel and oxygenate. They can also exhibit substantial synergistic reductions in particulate emissions when compared to the base fuel alone.

$NO_x$ and particulate emission levels can be assessed using standard test procedures such as the European R49, ESC, OICA or ETC (for heavy-duty engines) or ECE+EUDC or MVEG (for light-duty engines) test cycles. Such tests can be conducted for instance on a heavy duty diesel engine such as a Mercedes Benz™ OM366 LA six cylinder turbo-charged engine, suitably an engine in its standard Euro-II emissions build. Regulated gaseous and particulate emissions may be determined using for example a Horiba Mexa™ 9100 gas measurement system and an AVL Smart Sampler™ respectively.

To summarize, it is possible in accordance with the present invention to retain the benefits of including an oxygenate in a fuel blend, whilst mitigating the associated drawbacks, and indeed further improving the overall blend performance, by inclusion of an additional Fischer-Tropsch derived component. Equally, one might obtain the benefits of a Fischer-Tropsch/base fuel blend but without, or with fewer of, its associated drawbacks, by inclusion of an oxygenate in accordance with the present invention.

We claim:

1. A fuel composition comprising (i) a base fuel, (ii) a Fischer-Tropsch derived gas oil and (iii) an oxygenate.

2. The fuel composition of claim 1 wherein the oxygenate (iii) comprises an ester of either a carboxylic acid or a vegetable oil.

3. The fuel composition of claim 1 wherein components (ii) and (iii) are present in an amount effective to provide a) a neutral or close to neutral effect on elastomeric components compared to that of the base fuel, and/or b) a neutral or better emissions performance compared to that of the base fuel, optionally in addition to a neutral or close to neutral density for the composition with respect to that of the base fuel.

4. The fuel composition of claim 3 wherein components (ii) and (iii) are present in an amount that cause a change in volume of the elastomeric components from 60% to 140% of that caused by the base fuel when tested under the same conditions.

5. The fuel composition of claim 3 wherein components (ii) and (iii) are present in an amount that cause a change in volume of the elastomeric components no higher than that caused by the base fuel alone.

6. The fuel composition of claim 3 wherein components (ii) and (iii) are present in an amount that cause a change in hardness of the elastomeric components from 70% to 130% of that caused by the base fuel when tested under the same conditions.

7. The fuel composition of claim 3 wherein components (ii) and (iii) are present in an amount that cause a change in hardness of the elastomeric components no higher than that of the base fuel alone.

8. The fuel composition of claim 3 wherein the emissions performance is the level of $NO_x$ emissions generated by a diesel engine running on the relevant fuel or fuel composition.

9. The fuel composition of claim 1 wherein the components (i) and (iii) are present in an amount that the density of the fuel composition is from 95% to 105% of that of the base fuel.

10. The fuel composition of claim 9 wherein the components (i) and (iii) are present in an amount that the density of the fuel composition is from 98% to 102% of that of the base fuel.

11. The fuel composition of claim 1 wherein the density of the fuel composition is from 0.75 to 0.9 g/cm$^3$.

12. The fuel composition of claim 1 wherein the base fuel has a boiling point within the range of 150 to 400° C.

13. A method of operating an engine with a fuel composition containing base fuel having a) a neutral or close to neutral effect on elastomeric components compared to that of the base fuel, and/or b) a neutral or better emissions performance compared to that of the base fuel, optionally in addition to a neutral or close to neutral density for the composition with respect to that of the base fuel, said method comprising operating the engine with a fuel composition comprising (i) a base fuel, (ii) a Fischer-Tropsch derived gas oil and (iii) an oxygenate.

14. A method of operating an engine with a fuel composition containing base fuel and an oxygenate having an effect on elastomeric components which is closer to that of the base fuel than is that of the blend of base fuel and oxygenate, and/or for the purpose of achieving an emissions performance which is as good as or better than that of the base fuel alone, said method comprising operating the engine with a fuel composition comprising (i) a base fuel, (ii) a Fischer-Tropsch derived gas oil and (iii) an oxygenate.

15. A method of operating an engine with a fuel composition containing base fuel and a Fischer-Tropsch derived gas oil having an effect on elastomeric components which is closer to that of the base fuel than is that of the blend of base fuel and gas oil, and/or an emissions performance which is as good as or better than that of the base fuel alone, said method comprising operating the engine with a fuel composition comprising (i) a base fuel, (ii) a Fischer-Tropsch derived gas oil and (in) an oxygenate.

16. A method of operating a diesel engine, and/or a vehicle which is driven by a diesel engine which method involves introducing into a combustion chamber of the engine a diesel fuel composition of claim 1.

17. A method of operating a diesel engine, and/or a vehicle which is driven by a diesel engine which method involves introducing into a combustion chamber of the engine a diesel fuel composition of claim 2.

18. A method of operating a heating appliance provided with a burner, which method comprises supplying to said burner a fuel composition of claim 1.

19. A method of operating a heating appliance provided with a burner, which method comprises supplying to said burner a fuel composition of claim 2.

20. A process for the preparation of a fuel composition, said process comprising blending a Fischer-Tropsch derived gas oil (ii) and an oxygenate (iii) with a base fuel (i).

21. A fuel composition comprising (i) a base fuel, (ii) a Fischer-Tropsch derived gas oil and (iii) one or more ester.

22. A method of operating an engine with a fuel composition containing base fuel having a) a neutral or close to neutral effect on elastomeric components compared to that of the base fuel, and/or b) a neutral or better emissions performance compared to that of the base fuel, optionally in addition to a neutral or close to neutral density for the composition with respect to that of the base fuel, said method comprising operating the engine with a fuel composition comprising (i) a base fuel, (ii) a Fischer-Tropsch derived gas oil and (iii) one or more ester.

23. A method of operating an engine with a fuel composition containing base fuel and an oxygenate having an effect on elastomeric components which is closer to that of the base fuel than is that of the blend of base fuel and oxygenate, and/or for the purpose of achieving an emissions performance which is as good as or better than that of the base fuel alone, said method comprising operating the engine with a fuel composition comprising (i) a base fuel, (ii) a Fischer-Tropsch derived gas oil and (iii) one or more ester.

24. A method of operating an engine with a fuel composition containing base fuel and a Fischer-Tropsch derived gas oil having an effect on elastomeric components which is closer to that of the base fuel than is that of the blend of base fuel and gas oil, and/or an emissions performance which is as good as or better than that of the base fuel alone, said method comprising operating the engine with a fuel composition comprising (i) a base fuel, (ii) a Fischer-Tropsch derived gas oil and (iii) one or more ester.

25. A method of operating a diesel engine, and/or a vehicle which is driven by a diesel engine which method involves introducing into a combustion chamber of the engine a diesel fuel composition of claim 21.

26. A method of operating a heating appliance provided with a burner which method comprises supplying to said burner a fuel composition of claim 21.

27. A fuel composition comprising (i) a diesel fuel, (ii) a Fischer-Tropsch derived gas oil and (iii) an oxygenate.

28. The fuel composition of claim 27 wherein the oxygenate (iii) comprises an ester of either a carboxylic acid or a vegetable oil.

29. The fuel composition of claim 27 wherein components (ii) and (iii) are present in an amount effective to provide a) a neutral or close to neutral effect on elastomeric components compared to that of the diesel fuel, and/or b) a neutral or better emissions performance compared to that of the diesel fuel, optionally in addition to a neutral or close to neutral density for the composition with respect to that of the diesel fuel.

30. The fuel composition of claim 29 wherein components (ii) and (iii) are present in an amount that cause a change in volume of the elastomeric components from 60% to 140% of that caused by the diesel fuel when tested under the same conditions.

31. The fuel composition of claim 29 wherein components (ii) and (iii) are present in an amount that cause a change in volume of the elastomeric components no higher than that caused by the diesel fuel alone.

32. The fuel composition of claim 29 wherein components (ii) and (iii) are present in an amount that cause a change in hardness of the elastomeric components from 70% to 130% of that caused by the diesel fuel when tested under the same conditions.

33. The fuel composition of claim 29 wherein components (ii) and (iii) are present in an amount that cause a change in hardness of the elastomeric components no higher than that of the diesel fuel alone.

34. The fuel composition of claim 29 wherein the emissions performance is the level of $NO_x$ emissions generated by a diesel engine running on the diesel fuel.

35. The fuel composition of claim 27 wherein the components (i) and (iii) are present in an amount that the density of the fuel composition is from 95% to 105% of that of the diesel fuel.

36. The fuel composition of claim 35 wherein the components (i) and (iii) are present in an amount that the density of the fuel composition is from 98% to 102% of that of the diesel fuel.

37. The fuel composition of claim 27 wherein the density of the fuel composition is from 0.75 to 0.9 g/cm$^3$.

38. The fuel composition of claim 27 wherein the diesel fuel has a boiling point within the range of 150 to 400° C.

39. A method of operating an engine with a fuel composition containing diesel fuel having a) a neutral or close to neutral effect on elastomeric components compared to that of the diesel fuel, and/or b) a neutral or better emissions performance compared to that of the diesel fuel, optionally in addition to a neutral or close to neutral density for the composition with respect to that of the diesel fuel, said method comprising operating the engine with a fuel composition comprising (i) a diesel fuel, (ii) a Fischer-Tropsch derived gas oil and (iii) an oxygenate.

40. A method of operating an engine with a fuel composition containing diesel fuel and an oxygenate having an effect on elastomeric components which is closer to that of the diesel fuel than is that of the blend of diesel fuel and oxygenate, and/or for the purpose of achieving an emissions performance which is as good as or better than that of the diesel fuel alone, said method comprising operating the engine with a fuel composition comprising (i) a diesel fuel, (ii) a Fischer-Tropsch derived gas oil and (iii) an oxygenate.

41. A method of operating an engine with a fuel composition containing diesel fuel and a Fischer-Tropsch derived gas oil having an effect on elastomeric components which is closer to that of the diesel fuel than is that of the blend of diesel fuel and gas oil, and/or an emissions performance which is as good as or better than that of the diesel fuel alone, said method comprising operating the engine with a fuel composition comprising (i) a diesel fuel, (ii) a Fischer-Tropsch derived gas oil and (iii) an oxygenate.

* * * * *